US010548425B1

(12) United States Patent
Drozd

(10) Patent No.: US 10,548,425 B1
(45) Date of Patent: Feb. 4, 2020

(54) FOLDABLE WINDOW DRESSING SUPPORT DEVICE

(71) Applicant: Ronald Drozd, Fort Lauderdale, FL (US)

(72) Inventor: Ronald Drozd, Fort Lauderdale, FL (US)

( * ) Notice: Subject to any disclaimer, the term of this patent is extended or adjusted under 35 U.S.C. 154(b) by 0 days.

(21) Appl. No.: 15/988,063

(22) Filed: May 24, 2018

Related U.S. Application Data

(60) Provisional application No. 62/510,535, filed on May 24, 2017.

(51) Int. Cl.
*A47H 19/00* (2006.01)

(52) U.S. Cl.
CPC ..... *A47H 19/00* (2013.01)

(58) Field of Classification Search
CPC ..... A47H 19/00; A47H 11/02; A47H 5/04; A47H 5/05; A47H 5/106; A47G 2200/106; A47G 25/1478; A47G 25/48; A47G 25/485; A47G 25/52; A47G 5/00; A47G 9/02; A47G 9/10; A47G 9/1009; A47G 9/1045; F16M 11/28
USPC ..... 248/205.1, 206.3, 447.1, 48.2; 160/330, 160/340, 348, 368.1
See application file for complete search history.

(56) References Cited

U.S. PATENT DOCUMENTS

| | | | | |
|---|---|---|---|---|
| 2,430,959 | A * | 11/1947 | Soff | A47H 19/00 160/38 |
| D171,595 | S * | 3/1954 | Harriton | D6/541 |
| 8,182,012 | B1 * | 5/2012 | Brister | B60P 3/40 296/26.11 |
| 9,302,717 | B1 * | 4/2016 | Rude | B60P 3/40 |
| 2014/0319296 | A1 * | 10/2014 | Clouser | H02J 7/0044 248/206.3 |

* cited by examiner

*Primary Examiner* — Muhammad Ijaz
(74) *Attorney, Agent, or Firm* — David P. Lhota; Lhota & Associates, P.A.

(57) ABSTRACT

A window dressing holding device for lifting and holding window dressings, such as draperies and curtains, off and above the floor and baseboards to facilitate more convenient cleaning or painting of the baseboards, lower walls or floors. The holding device includes a face plate, base plate, at least one hinge pivotally connecting the face plate to the base plate, first or left side panel having inward projecting flanges at opposite ends, second or right side panel having inward projecting flanges at opposite ends, at least one left side hinge pivotally connecting the left side panel to one end of the face plate, at least one right side hinge pivotally connecting the right side panel to an opposite end of the face plate, a left side bottom flange projecting inward from a lower end of the left side panel, a right side bottom flange projecting inward from a lower end of the right side panel wherein the bottom flanges support the base plate when the holding device is in use, and a plurality of suction cups wherein each suction cup is mounted to and projects outward from respective side panel flanges.

11 Claims, 7 Drawing Sheets

FOLDABLE WINDOW DRESSING SUPPORT DEVICE

CROSS-REFERENCE TO RELATED APPLICATION

This application claims the benefit of provisional application Ser. No. 62/510,535 filed May 24, 2017.

STATEMENT REGARDING FEDERALLY SPONSORED RESEARCH OR DEVELOPMENT

N/A

FIELD OF THE INVENTION

The present invention relates to a window dressing elevation accessory, and in particular, to a foldable window dressing support device that attaches to a window, wall or other flat surface and holds curtains, drapes or other window or wall dressings in an elevated position above and off the floor or wall to facilitate convenient cleaning or maintenance of the floor, baseboard or wall below or behind the curtain. The instant invention is portable for cleaning, painting or otherwise performing maintenance on the baseboard or wall behind the curtain in multiple locations. The window curtain elevation accessory of the instant invention is also foldable for convenient packaging and storage.

BACKGROUND OF THE INVENTION

Curtains, drapes and other window dressings or coverings, especially those of the full-length variety, are well known to provide an obstacle to vacuuming or cleaning the floor and baseboards in homes and offices. They typically hang in front of a wall or baseboard and are difficult to work around or to hold back while cleaning the floor, baseboards or wall. In fact, the window dressings can be soiled when trying to clean or perform maintenance to the areas in their vicinity which would then require cleaning the window dressing. It is common to just hold or place the window dressing on one's arm or piece of furniture, but this impedes the ability to paint or clean and is also unreliable. Strings, straps, hooks or other types of hanger devices have also been used to hold curtains, drapes or other window coverings above or away from the floor, baseboard or wall. However, the cord must be tied or secured to a stationery object, such as a curtain rod, which can be difficult to implement and tedious, especially when someone is too short to reach the curtain rod or when dealing with multiple windows and window coverings throughout a house or office. Moreover, using cords, arms or furniture to hold window dressing can be unstable, unreliable and ultimately fail because of the weight or bulk of the curtains, drapes or coverings, which results in the curtain or drapery falling through the cord and getting soiled. This process is especially tedious, time consuming and frustrating when multiple sets of window coverings must be cleared away for routing maintenance or cleaning. There exists a need for a device that could not only reliably isolate, elevate and support window coverings away from the floor and, or wall while painting, cleaning or performing other maintenance on floors, baseboards or walls, but that could also be conveniently and easily moved from one location to another. In fact, such a device would be even more desirous if it could be quickly folded for packaging or storage. However, there are no devices known that adequately and effectively protect window coverings when performing these maintenance tasks and that may be moved easily and quickly.

It is therefore desirable to have a device that could conveniently, reliably, quickly and efficiently support curtains, draperies and other window coverings above or away from a floor or wall when cleaning, painting or performing other maintenance on multiple windows or wall surfaces. If there existed a device that addressed these shortcomings in the background art it would be well received. However, there are no devices known that conveniently, reliably and efficiently hold and protect curtains, draperies and other window dressings when performing routine cleaning or maintenance. As there are no known devices that satisfy or meet these objectives, there exists a need for such a device. It is, therefore, to the effective resolution of the aforementioned problems and shortcomings of the prior art that the present invention is directed. The instant invention addresses this unfulfilled need in the prior art by providing a foldable, moveable and transportable window dressing support device as contemplated by the instant invention disclosed herein.

SUMMARY OF THE INVENTION

In accordance with one aspect, the present invention provides a window dressing holding device for lifting and holding window dressings, such as draperies and curtains, off and above the floor and baseboards to facilitate more convenient cleaning or painting of the baseboards, lower walls or floors. The holding device includes a face plate, base plate, at least one hinge pivotally connecting the face plate to the base plate, first or left side panel having inward projecting flanges at opposite ends, second or right side panel having inward projecting flanges at opposite ends, at least one left side hinge pivotally connecting the left side panel to one end of the face plate, at least one right side hinge pivotally connecting the right side panel to an opposite end of the face plate, a left side bottom flange projecting inward from a lower end of the left side panel, a right side bottom flange projecting inward from a lower end of the right side panel wherein the bottom flanges support the base plate when the holding device is in use, and a plurality of suction cups wherein each suction cup is mounted to and projects outward from respective side panel flanges.

In another aspect, the present invention provides a window dressing holding device that includes a face plate hinged to a base plate, at least one hinge pivotally connecting the face plate to the base plate, first side panel having inward projecting flanges at opposite ends, second side panel having inward projecting flanges at opposite ends, at least one first hinge pivotally connecting the first side panel to one end of the face plate, at least one second side hinge pivotally connecting the second side panel to an opposite end of the face plate, a first side bottom flange projecting inward from a lower end of the first side panel, a second side bottom flange projecting inward from a lower end of the second side panel, first side tab pivotally connected to the first bottom flange and a second side tab pivotally connected to the second bottom flange wherein the first and second tabs pivot inward to support the base plate when the holding device is in use, a plurality of suction cups wherein each suction cup is mounted to and projects outward from respective side panel flanges and a plurality of apertures formed in the face plate and base plate to create airflow and reduce static to prevent the window dressing from clinging to the plates and to reduce weight.

In an additional aspect, the present invention provides a window dressing holding device that includes a face plate hinged to a base plate, at least one hinge pivotally connecting the face plate to the base plate, left side upper panel having inward projecting flanges at opposite ends, left side lower panel having inward projecting flanges at opposite ends, right side upper panel having inward projecting flanges at opposite ends, right side lower panel having inward projecting flanges at opposite ends, at least one left side upper hinge pivotally connecting the upper left side panel to a left end of the face plate, at least one left side lower hinge pivotally connecting the lower left side panel to the left end of the face plate, at least one right side upper hinge pivotally connecting the right side upper panel to a right end of the face plate, at least one right side lower hinge pivotally connecting the right side lower panel to a right end of the face plate, a left side bottom flange projecting inward from a lower end of the left side panel, a right side bottom flange projecting inward from a lower end of the right side panel, first side tab pivotally connected to the first bottom flange and a second side tab pivotally connected to the second bottom flange wherein the first and second tabs pivot inward toward to support the base plate when the holding device is in use, a left side support bracket connected to the left side upper panel and lower panel to stabilize the left side upper and lower side panels and to facilitate the use of less material, a right side support bracket connected to the right side upper panel and lower panel to stabilize the right side upper and lower side panels and to facilitate the use of less material, a plurality of suction cups wherein each suction cup is mounted to and projects outward from respective side panel flanges and a plurality of apertures formed in the face plate and base plate to create airflow and reduce static to prevent the window dressing from clinging to the plates and to reduce weight.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 3:
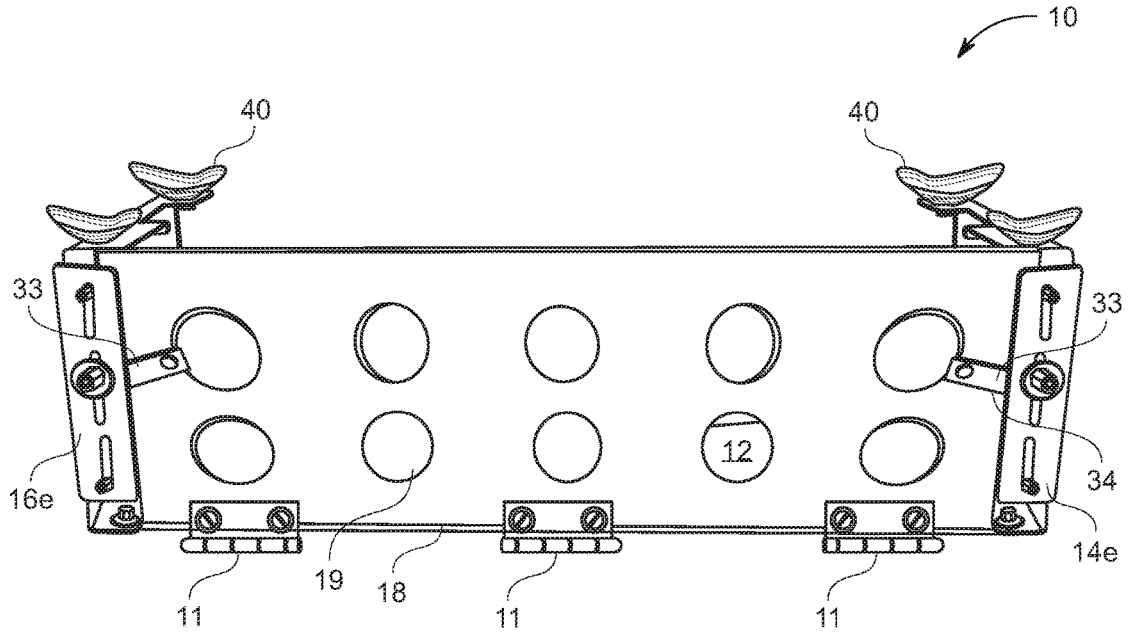
FIG. 3 is a bottom perspective view of the window dressing support device of FIG. 1 in accordance with the principles of a preferred embodiment of the present invention.
Figure 4:
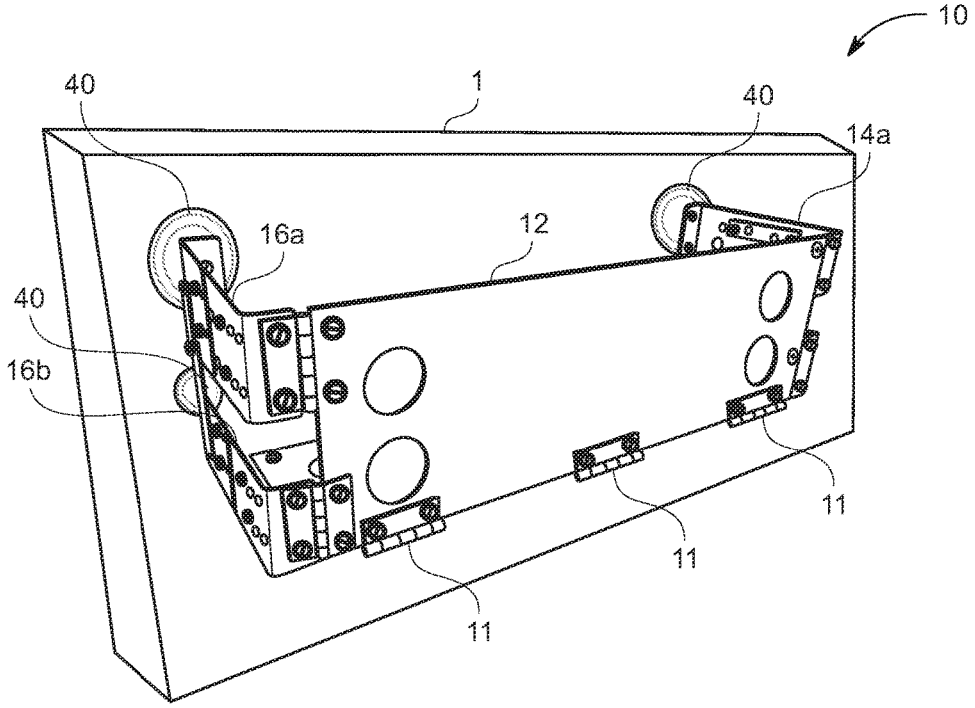
FIG. 4 is a front perspective view of the window dressing support device of FIG. 1 showing the holding device mounted to a wall or window in accordance with the principles of a preferred embodiment of the present invention.

With reference to the drawings in which like reference designators refer to like elements, FIGS. 1 to 11 depict the preferred and alternative embodiments of the instant invention which is generally referenced as a window dressing support device, support device and, or by numeric character 10. There is shown in FIGS. 1-8 a window dressing support device 10 for holding or supporting window dressings 1, such as curtains and drapery, above a floor or away from a wall to facilitate convenient cleaning, painting or maintenance of the floor or wall. The instant invention 10 may also be used to hold cleaning and maintenance items when working. The support device 10 may be secured to a window or wall, as shown in FIG. 4, or window and provides a trough for placing the window dressing when lifted off or above the floor. The device 10 is foldable into a rectangular cube for convenient packaging when shipping or sold, storage and relocating. The device 10 is easily moveable to other positions or locations for use throughout a house or office.

With reference to FIGS. 1-8, the preferred embodiment of the window dressing support device 10 provides a window dressing holding device that includes a face plate 12 hinged to a base plate 18, at least one hinge 11 pivotally connecting the face plate 12 to the base plate 18, left side upper panel 14*a* having inward projecting flanges 14*c* at opposite ends, left side lower panel 14*b* having inward projecting flanges 14*d* at opposite ends, right side upper panel 16*a* having inward projecting flanges 16*c* at opposite ends, right side lower panel 16*b* having inward projecting flanges 16*d* at opposite ends, at least one left side upper hinge 15*a* pivotally connecting the upper left side panel 14*a* to a left end of the face plate 12, at least one left side lower hinge 15*b* pivotally connecting the lower left side panel 14*b* to the left end of the face plate 12, at least one right side upper hinge 17*a* pivotally connecting the right side upper panel 16*a* to a right end of the face plate 12, and at least one right side lower hinge 17*b* pivotally connecting the right side lower panel 17*b* to a right end of the face plate 12. The left side panels 14*a*, 14*b* and right side panels 16*a*, 16*b* fold outward to pivot the base plate 18 into place at a ninety degree angle with the face plate 12 and then inward toward the outside edges of the base plate 18 to support the base plate 18 for use. The device 10 includes a left side bottom flange 14*e* projecting inward from the lower end of the left side panel 14 and a right side bottom flange 16*e* projecting inward from a lower end of the right side panel 16*e*. A left side tab 34 is pivotally connected to the left side bottom flange 14*e* and a second side tab 35 is pivotally connected to the right side bottom flange 16*e* wherein the first and second tabs 34, 35 pivot inward toward and under the base plate 18 to support the base plate 18 when the holding device is in use, as shown in FIGS. 3 and 4. In an alternative embodiment, the support tabs 34, 35 may be pivotally connected, mounted or attached to the lower side panels 14*b*, 16*b*, such as in an embodiment of the invention 10 that does not utilize bottom flanges 14*e*, 16*e*.

Now referring to FIGS. 1-4, the side panels 14*a,b* and 16*a,b* are narrow substrates that form a separation as supported by the face plate 12. This provides the effect of a complete side panel without using all the material necessary for a full panel to reduce weight and manufacturing cost. To stabilize the upper and lower side panels 14*a,b* and 16*a,b*, the instant invention 10 includes a left side support bracket 32 connected to the left side upper panel 14*a* and left side lower panel 14*b* and a right side support bracket 33 connected to the right side upper panel 16*a* and right side lower panel 16*b*.

Now referring to FIGS. 1-8, the window dressing support device 10 is supported on a window or wall 1 by suction cups 40. The support device 10 includes a plurality of suction cups 40 wherein each suction cup 40 is mounted to and projects outward from respective side panel flanges 14*c,d* and 16*c,d*. The side flanges 14*c,d* and 16*c,d* include apertures which receive a knob on the inside end of the suction cups 40 to support the suction cups 40.

Now referring to FIGS. 1-5, the face plate 12 and base plate 18 include a plurality of apertures 22, 19, respectively, for an aerodynamic advantage that creates airflow and reduces static to prevent the window dressing from clinging to the plates 12, 18 while reducing weight. As the window dressing 1 tends to rest in on the bottom plate 18, the bottom plate 18 preferably has more apertures than the face plate 12. The side panels 14*a,b* and 16*a,b* may also have apertures. The device 10, and more particularly the face panel 12, base panel 18, and side panels 14*a,b* and 16*a,b*, are preferably manufactured from polypropylene plastic or comparable substitute for weight reduction and mass production. The device 10 may be manufactured from another material without departing from the scope and spirit of the instant invention 10.

Figure 5:
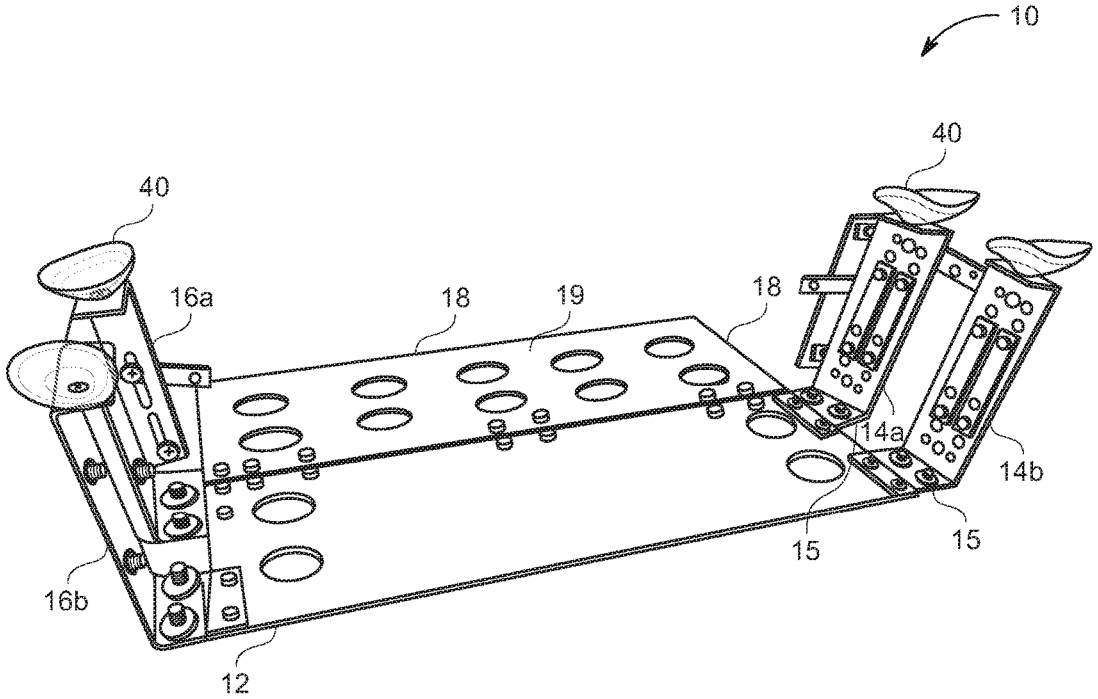
FIG. 5 is a top perspective view of the window dressing support device of FIG. 1 showing the holding device in a first open position in accordance with the principles of a preferred embodiment of the present invention.
Figure 6:
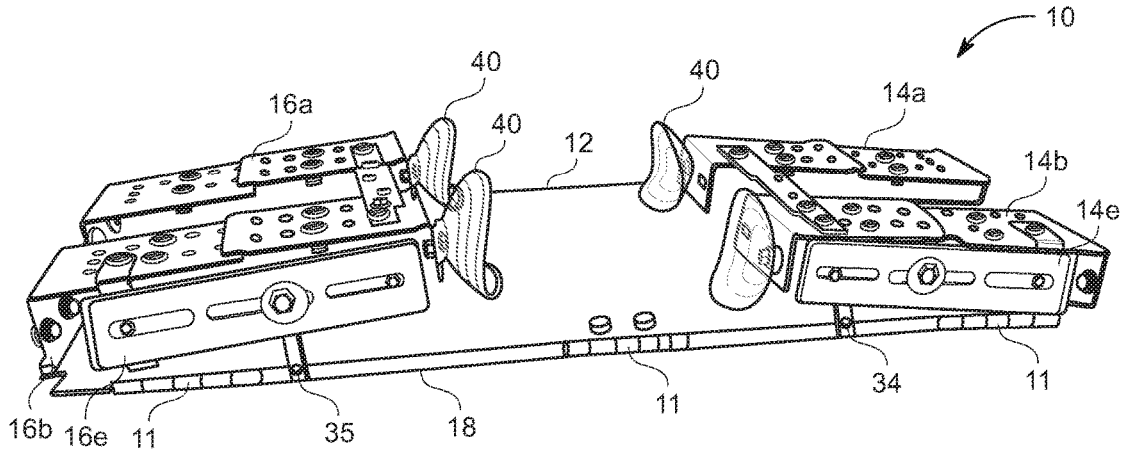
FIG. 6 is a bottom perspective view of the window dressing support device of FIG. 1 showing the holding device in a partially closed position and illustrating the support tabs in an extended position in accordance with the principles of a preferred embodiment of the present invention.
Figure 7:
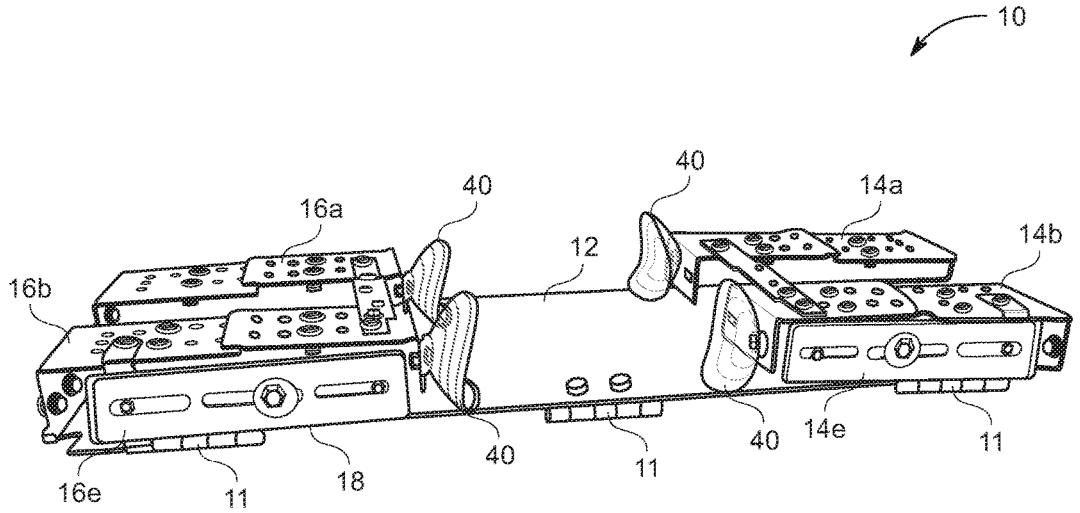
FIG. 7 is a bottom perspective view of the window dressing support device of FIG. 1 showing the holding device in a fully closed position in accordance with the principles of a preferred embodiment of the present invention.
Figure 8:
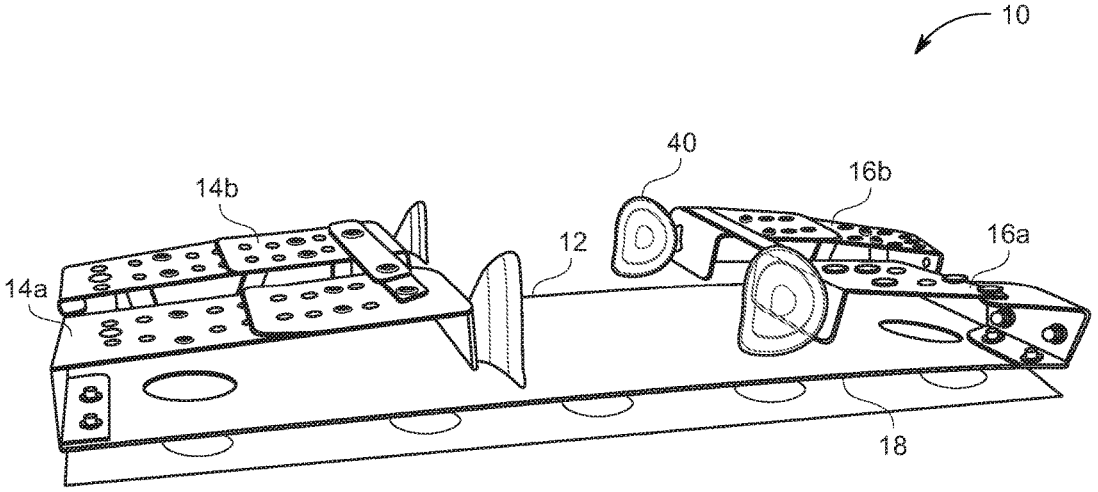
FIG. 8 is a top perspective view of the window dressing support device of FIG. 1 showing the holding device in a fully closed position in accordance with the principles of a preferred embodiment of the present invention.

Now referring to FIGS. 5-8, the window dressing support device 10 is able to fold into a compact form by virtue of the hinges 11, 15 and 17 and the shape of the side panels 14*a,b*, 16*a,b*, including the side panel flanges 14*c,d* and 16*c,d* (generally and collectively referenced by numerals 14 and 16), and the dimensions of the face plate 12 and base plate 18 relative to the side panels 14, 16. The base plate 18 is pivotally connected to the face plate 12 by at least one and preferably a plurality of hinges 11 that enable the base plate 18 to swing backward over the outside front surface of the face plate 12, as shown in FIG. 5. Meanwhile, the side panels 14, 16 swing inward over the rear surface of the face panel 12, as shown in FIGS. 6-8. Referring to FIG. 6, the support tabs 34, 35 are shown extended before being pivoted into and over the bottom flanges 14*e*, 16*e*, respectively. In FIG. 7, the tabs 34 and 35 are shown fully pivoted inside the lower side panels 14*b*. 16*b*.

Figure 9:
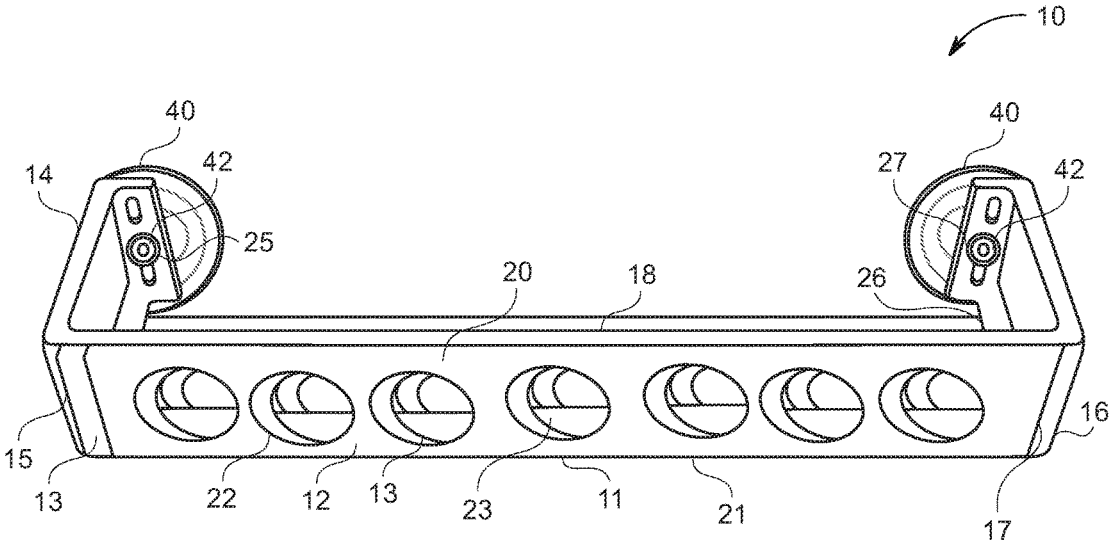
FIG. 9 is front perspective view of the window dressing support device in accordance with the principles of an alternative embodiment of the present invention.
Figure 10:
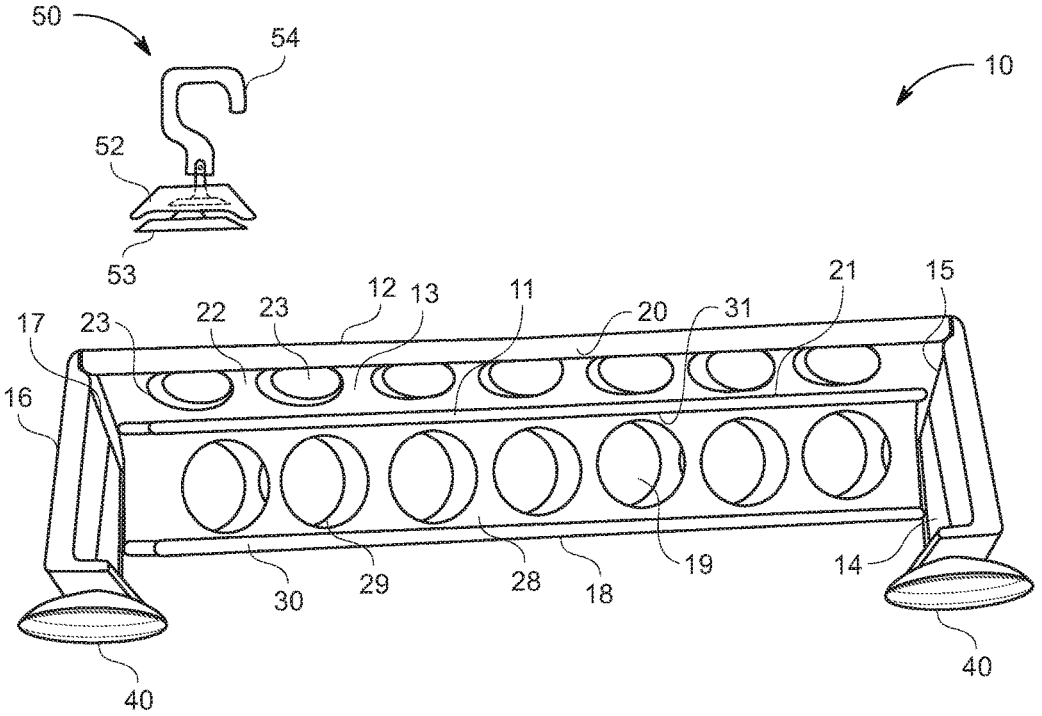
FIG. 10 is a rear perspective view of window dressing support device shown in FIG. 9 and an alternative lockable suction cup for mounting the device on virtually any surface.
Figure 11:
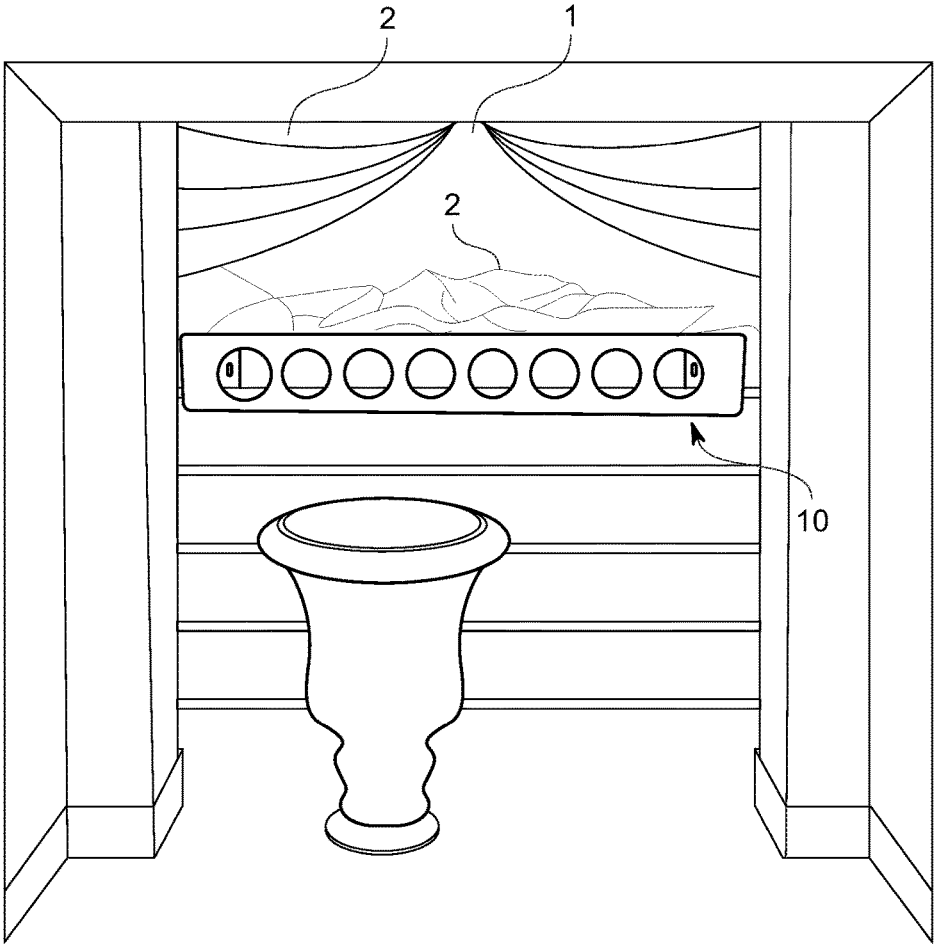
FIG. 11 is front perspective view of the window dressing support device of FIG. 9 in use over a window.

There is shown in FIGS. 9-11 an alternative embodiment of the window dressing support device 10 for holding or supporting window dressings 1, such as curtains and drapery, above a floor or away from a wall to facilitate convenient cleaning or maintenance of the floor or wall. The instant invention 10 may also be used to hold cleaning and maintenance items when working. The support device 10 may be secured to a window, as shown in FIG. 11, or wall and provides a trough for placing the window dressing. The device 10 is extendable and retractable for accommodating larger or smaller window dressings. The device 10 is easily moveable to other positions or locations for use throughout a house or office and is foldable for convenient packaging when sold or storage when not in use.

With reference to FIGS. 9 and 10, in the alternative embodiment the window dressing support device 10 generally includes a face plate 12, base plate 18, left side panel 14 and right side panel 16, which form a trough for holding or supporting a window dressing, and a pair of suction cups 40 removably attached to the side panels 14, 16, respectively, for mounting the support device 10 to a window or wall. The support device 10, more particularly, includes an exterior face plate 12, interior face plate 13, bottom base plate 18, top base plate 28, left side panel 14 connected to the rear face plate 13 and right side panel 16 connected to the front face plate 12. The support device 10 includes a base plate 18 to prevent the window dressing 1 from falling through the support device 10. The exterior face plate 12 preferably has an upper flange 20 and lower flange 21 that each define opposing channels for slidably receiving the interior face plate 13. The interior face plate 13 slides through the flange channels formed by the flanges 20, 21 to adjust the width of the face plate 12, 13. The interior face plate 13 may be connected or connectable to the left side plate 14 to facilitate the sliding of the interior face plate 13. Similarly, the bottom base plate 18 has an inner flange 30 and outer flange 31 that each define opposing channels for slidably receiving the top base plate 28. The top base plate 28 slides through the flange channels formed by the flanges 30, 31 to adjust the width of the base plate 18, 28. The top base plate 28 may be connected or connectable to the left side plate 14 to create movement of the top base plate 28. The interior face plate 13 and top base plate 28 preferably extend and retract together or simultaneously for adjusting the width of the support device 10. To facilitate the simultaneous sliding of the interior face plate 13 and top base plate 28, the left side plate 14 is preferably connected to the interior face plate 13 and top base plate 28. In an alternative embodiment, the left side plate 14 may be connected to the exterior face plate 12 and the right side plate 16 connected to the interior face plate 13 so long as the interior face plate 13 is slidable within the channels of the front face plate 12. Similarly, the left side plate 14 may be connected to the bottom base plate 18 and the right side plate 16 connected to the top base plate 28.

Figure 1:
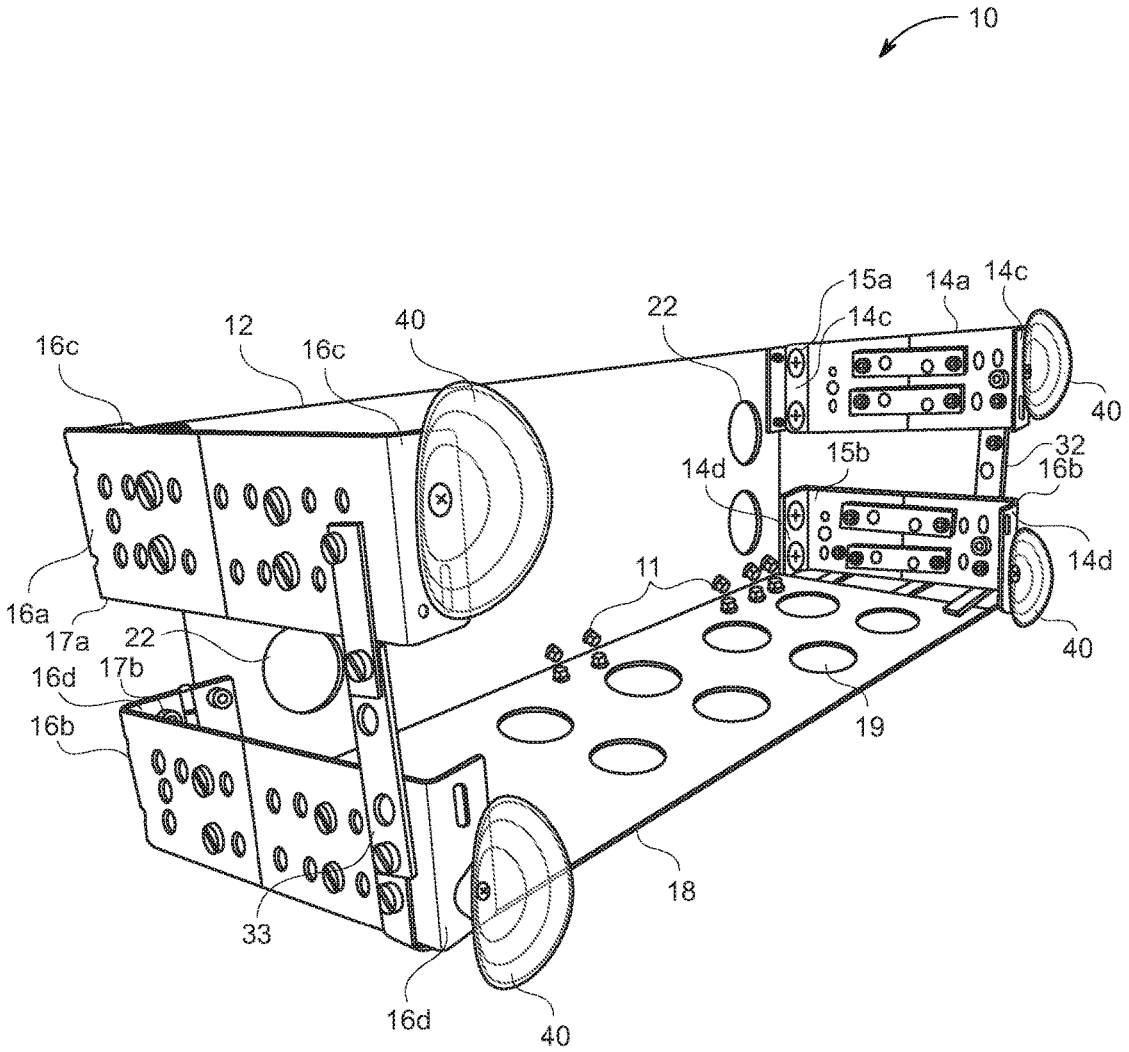
FIG. 1 is rear perspective view of the window dressing support device in accordance with the principles of a preferred embodiment of the present invention.
Figure 2:
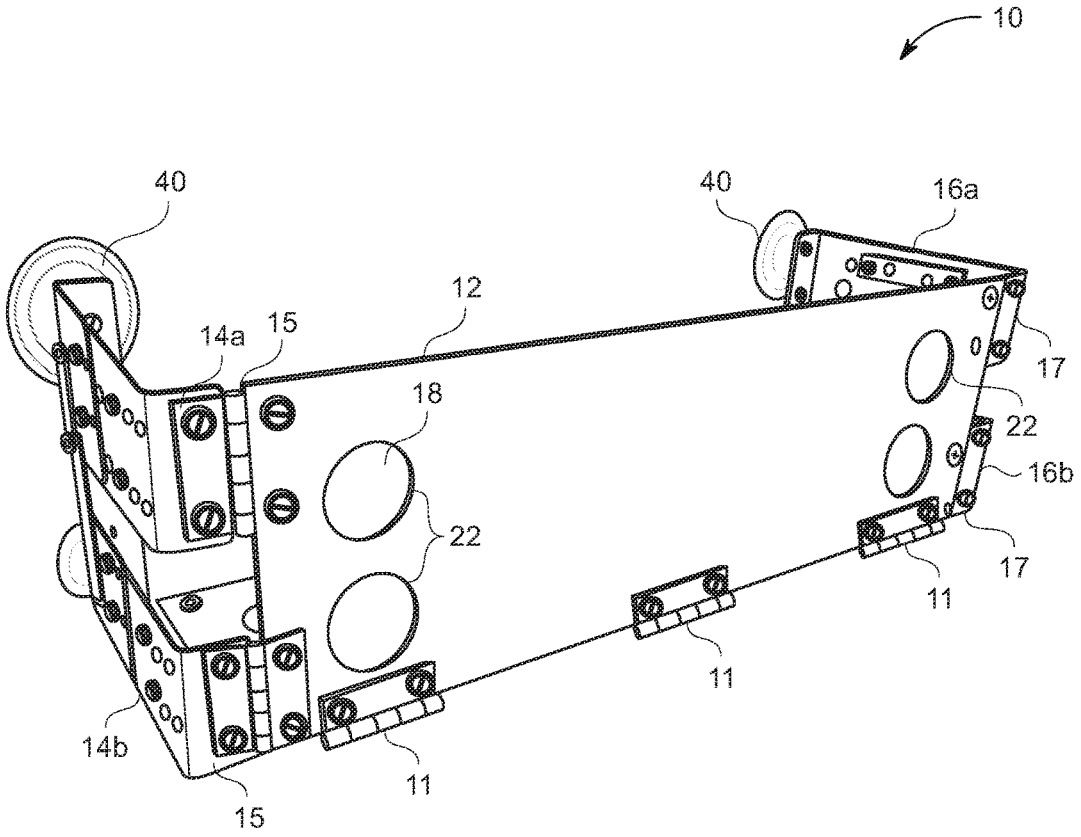
FIG. 2 is a front perspective view of the window dressing support device shown in FIG. 1 in accordance with the principles of a preferred embodiment of the present invention.

Continuing to refer to FIGS. 9 and 10, the window dressing support device 10 is preferably foldable wherein the left side plate 14 or right side plate 16 are connected to the interior face plate 12 or exterior face plate by a hinge 15 and hinge 17, respectively. The hinges 15, 17 may facilitate pivoting movement of the left side plate 14 and right side plate 16 inward or outward with respect to the exterior or interior face plate 12, 13. Likewise, the bottom base plate 18 is preferably connected to the exterior face plate 12 by a hinge 11, as shown in FIG. 1, which may allow pivoting movement inward or outward with respect to the exterior face plate 12. The left side plate 14 or right side plate 16 may be releasably connectable to the top base plate 28 by snapping together with grips, tabs, apertures and, or grooves that cooperate to snap in place when pressed together which causes the top base plate 28 to slide when the left side plate 14 or right side plate 16 are pulled or pushed. The left side plate 14 or right side plate 16 may be detached from the top base plate 28 by securing the plate 28 when pulling on the left or right side plate 14, 16. When detached, the side plates 14, 16 and base plates 18, 28 may be pivoted inward or outward toward and against the exterior or interior face plates 12, 13 to fold the window dressing support device 10 for packaging or storage.

Referring to FIGS. 9-11, the face plates 12, 13 and base plates 18, 28 are preferably perforated. The exterior face plate 12 includes a plurality of apertures 22 and the interior face plate 13 includes a plurality of apertures 23. The bottom base plate 18 includes a plurality of apertures 19 and the top base plate 28 includes a plurality of apertures 29. The perforated plates 12, 13, 18 and 28 help to alleviate or prevent static electricity with the window dressing while reducing the amount of material required to produce the plates so as to reduce manufacturing costs.

Still referring to FIGS. 9 and 10, the left side plate includes a flange 24 and the right side plate includes a flange 26. The flanges 24, 26 may be hinged to the left side plate 24 and right side plate 26 to facilitate folding of the support device 10. The left side flange 24 includes an aperture 25 and the right side flange 26 includes an aperture 27. A suction cup 40 having a mounting knob 42 is mountable to each flange 24 and 26, respectively, by inserting the mounting knob 42 of each cup 40 into a corresponding flange aperture 26 or 27. An alternative lockable suction cup 50 may be employed to facilitate more reliable mounting to wall surfaces made from wood, concrete or drywall. The lockable suction cup 50 includes a base 52 with a bladder 53 and a hook 54 pivotally connected to the bladder 53 to pull it inward when rotated thereby creating suction on the mounting surface to securely mount the suction cup 50. The window dressing support device 10 is then mountable to the hooks 54 as needed for lifting and supporting window dressings.

Now referring to FIG. 1, the window dressing support device 10 is shown mounted to a window 1. A curtain or drape 2 is lifted and placed in the trough of the support device 10 when the window, baseboard or wall require cleaning or maintenance, as shown. The support device 10 may be widen to accommodate larger window dressings by pulling on the side plate 14 or 16 that is connected to the interior face plate 13 and top base plate 28.

The window dressing support device 10 is preferably manufactured from a thermoplastic, plastic or other material amenable to injection molding and mass production. The support device 10 may alternatively be made from fiberglass, aluminum, stainless steel or other rustproof material.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A window dressing support device for supporting curtains, drapes or blinds, said support device comprising:
- a face plate having a front surface and a rear surface;
- a base plate pivotally connected to said face plate such that said base plate is pivotable toward said rear surface of said face plate and over said front surface of said face plate;
- a first side panel pivotally connected to a first end of said face plate;
- a second side panel pivotally connected to a second end of said face plate;
- at least one support means extendable from said first side panel for supporting said base plate when it is pivoted toward said rear surface of said face plate;
- a first bottom flange extending inward from a lower end of said first side panel;
- said at least one support means comprises a support tab pivotally extendable from said first bottom flange for engaging an outer surface of said base plate for supporting said base plate; and
- mounting means for mounting said support device to a support surface.

2. The support device of claim 1, wherein said support device further comprises:
- a second bottom flange extending inward from a lower end of said second side panel;
- and a second support means comprising a second support tab pivotally extendable from said second bottom flange for engaging said outer surface of said base plate for supporting said base plate.

3. The support device of claim 1, further comprising:
- a first side panel flange extending inward from said first side panel;
- a second side panel flange extending inward from said second side panel; and
- said mounting means comprising a first suction cup mountable to said first side panel flange and a second suction cup mountable to said second side panel flange.

4. The support device of claim 1, wherein:
- said first side panel comprises a first upper side panel substrate and a first lower side panel substrate;
- said second side panel comprises a second upper side panel substrate and a second lower side panel substrate; and
- said mounting means comprises a first upper suction cup mountable to said first upper side panel substrate, a first lower panel suction cup mountable to said first lower panel substrate, a second upper panel suction cup mountable to said second upper side panel substrate and a second lower suction cup mountable to said second lower side panel substrate.

5. The support device of claim 4, wherein:
- said first upper side panel substrate having a first upper flange projecting inward from said first upper side panel substrate;
- said first lower side panel substrate having a first lower flange projecting inward from said first lower side panel substrate;
- said second upper side panel substrate having a second upper flange projecting inward from said second upper side panel substrate; and
- said second lower side panel substrate having a second lower flange projecting inward from said second lower side panel substrate.

6. The support device of claim 5, wherein said mounting means comprises:
- the first upper suction cup mountable to said first upper flange;
- a first lower suction cup mountable to said first lower flange;
- a second upper suction cup mountable to said second upper flange; and
- the second lower suction cup mountable to said second lower flange.

7. The support device of claim 6, wherein further comprising:

a first support bracket connected to said first upper side panel and said first lower side panel; and a second support bracket connected to said second upper side panel and said second lower side panel.

8. The support device of claim 5, wherein further comprising:

a first support bracket connected to said first upper side panel and said first lower side panel; and a second support bracket connected to said second upper side panel and said second lower side panel.

9. The support device of claim 5, further comprising:

a plurality of apertures defined in said base plate; and a plurality of apertures defined in said face plate.

10. The support device of claim 1 further comprising:

a plurality of apertures defined in said face plate.

11. The support device of claim 1, further comprising:

a plurality of apertures defined in said base plate.

* * * * *